United States Patent [19]

Desmond, Jr.

[11] 4,240,801

[45] Dec. 23, 1980

[54] DIESEL FUEL COMPOSITION

[75] Inventor: Edwin A. Desmond, Jr., Grosse Pointe, Mich.

[73] Assignee: Ethyl Corporation, Richmond, Va.

[21] Appl. No.: 44,310

[22] Filed: May 31, 1979

Related U.S. Application Data

[63] Continuation-in-part of Ser. No. 942,114, Sep. 13, 1978, abandoned.

[51] Int. Cl.[3] ..... C10L 1/22

[52] U.S. Cl. ..... 44/57; 44/63

[58] Field of Search ..... 44/57, 68

[56] References Cited

U.S. PATENT DOCUMENTS

| | | | |
|---|---|---|---|
| 2,031,497 | 2/1936 | Marvel . | |
| 2,158,050 | 5/1939 | Bereslavsky . | |
| 2,280,217 | 4/1942 | Cloud | 44/57 |
| 2,324,779 | 7/1943 | Kass . | |
| 2,618,650 | 11/1952 | Hinkamp . | |
| 2,818,417 | 12/1957 | Brown et al. . | |
| 2,839,552 | 6/1958 | Shapiro et al. | 44/68 |
| 2,934,048 | 4/1960 | Young . | |
| 3,001,857 | 9/1961 | Pollock . | |
| 3,153,901 | 10/1964 | Rifkin | 44/68 |
| 3,891,401 | 6/1975 | Watson et al. | 44/57 |

*Primary Examiner*—Winston A. Douglas
*Assistant Examiner*—Y. Harris Smith
*Attorney, Agent, or Firm*—Donald L. Johnson; Joseph D. Odenweller; Willard G. Montgomery

[57] ABSTRACT

A fuel oil composition containing a combination of a cyclopentadienyl manganese tricarbonyl and an alkyl nitrate to reduce particulate emissions.

23 Claims, No Drawings

DIESEL FUEL COMPOSITION

CROSS-REFERENCE TO RELATED APPLICATIONS

This application is a continuation-in-part of Ser. No. 942,114 filed Sept. 13, 1978, now abandoned.

BACKGROUND OF THE INVENTION

High speed Diesel-type engines are well known for their durability under severe operating conditions. Because of this, they have found favor for use in large, heavy-duty motor vehicles, such as trucks, buses, and in locomotives. Recently, however, the use of this type of engine in light-duty road vehicles, such as passenger cars, has begun to increase sharply, this is due largely to industry attempts to achieve increased fuel ecomony. One particular problem associated with the use of diesel engines, however, is the emission of particulate matter derived from the heavy motor fuels containing low volatility ends on which these engines operate. Accordingly, as these engines become more widely used in light-duty road vehicles, a method for reducing the amount of particulate emissions that accompany their operation would be very desirable.

In accordance with the present invention, it has now been found that certain organic nitrates when added in combination with a cyclopentadienyl manganese tricarbonyl to liquid hydrocarbon fuels unexpectedly cooperate to reduce the particulate emitting tendencies of these fuels.

It is known that cyclopentadienyl manganese compounds are excellent antiknocks in gasoline used to operate internal combustion engines and have proven to be especially beneficial in solving some of the problems associated with the use of low-lead or lead-free gasoline in internal combustion engines. Use of such compounds as antiknocks is described in U.S. Pat. Nos. 2,818,417; 2,839,552, and 3,127,351, all incorporated herein by reference.

It is also known that the ignition quality of diesel fuels can be increased by the addition thereto of certain organic nitrate compounds. For example, U.S. Pat. No. 2,280,217 discloses an improved fuel for compression-ignition engines of the Diesel-type which comprises a hydrocarbon fuel having a flash-point above 150° F. and a small amount of an alkyl nitrate having at least 10 carbon atoms per molecule. U.S. Pat. No. 2,031,497 discloses a compression-ignition fuel comprising a fuel oil boiling above the gasoline range containing the nitrates of the mixture of open branched chain aliphatic monohydric alcohols obtainable by the catalytic hydrogenation of carbon monoxide and having at least 4 carbon atoms and containing isobutyl alcohol. U.S. Pat. No. 2,324,779 teaches the use of alkyl nitrates containing 3–6 carbon atoms per molecule as having ignition acceleration effects when used in motor fuels. U.S. Pat. No. 2,618,650 discloses the use of nitrate esters of the isomeric amyl alcohols as being effective for increasing the ignition quality of diesel fuels. U.S. Pat. No. 3,001,857 discloses a composite diesel additive consisting of a blend of a high-grade hydrocarbon diesel oil and a substance selected from a group of substances consisting of alkyl nitrates and N-alkyl, N-nitro and alkyl carbamates. U.S. Pat. No. 2,905,540 discloses the use of nitric acid esters of hydroaromatic or cycloaliphatic alcohols in diesel fuels to increase the cetane number of such fuels. U.S. Pat. No. 3,415,632 discloses a fuel oil composition containing a combination of cyclohexylnitrate and an oil-soluble barium salt of a sulfonic acid to inhibit exhaust smoke emission. U.S. Pat. No. 2,158,050 teaches the use of $C_1$–$C_5$ alkyl nitrates as cetane improvers.

It has now been found that when organic nitrates of the aforediscussed type, which have previously found use as ignition accelerators in diesel fuels, are added to liquid hydrocarbon fuel in combination with a cyclopentadienyl manganese tricarbonyl an unexpected reduction in the particulate emitting tendencies of the composite fuel is obtained.

SUMMARY OF THE INVENTION

Accordingly, the present invention is directed to improved hydrocarbon fuels, such as diesel fuel mixtures, having lower particulate emitting tendencies, characterized in that they contain a cyclopentadienyl manganese tricarbonyl and certain organic nitrates.

DESCRIPTION OF THE PREFERRED EMBODIMENT

The essence of the present invention resides in the reduction of particulate emissions from diesel engines which burn a hydrocarbon fuel. This reduction in particulate emission is effected by the addition to the fuel of a cyclopentadienyl manganese tricarbonyl and certain organic nitrates. Accordingly, a preferred embodiment of the present invention is an improved fuel composition comprising a major amount of a fuel oil and a minor amount sufficient to reduce particulate emissions of (1) a cyclopentadienyl manganese tricarbonyl, and (2) a lower alkyl or cycloalkyl nitrate.

A further embodiment of the present invention is an improved fuel composition comprising a major amount of a fuel oil and a minor amount sufficient to reduce particulate emissions of (1) a cyclopentadienyl manganese tricarbonyl, and (2) an alkyl or cycloalkyl nitrate having from 3–10 carbon atoms per molecule.

A still further embodiment of the present invention is an improved fuel composition comprising a major amount of a fuel oil and a minor amount sufficient to reduce particulate emissions of (1) a cyclopentadienyl manganese tricarbonyl, and (2) an alkyl nitrate selected from amyl nitrate, hexyl nitrate, mixtures of amyl and hexyl nitrates, mixtures of primary amyl nitrates, and mixtures of primary hexyl nitrates.

The base fuel for use in accordance with the present invention may be any fuel oil, such as gas oil, distillate oil or furnace oil, but is preferably an oil which boils in the kerosene and gas oil range. In general, such fuel oil fractions have an initial boiling point of about 400° F. and an end boiling point of about 700° F.

The cyclopentadienyl manganese compounds used in the present invention are the cyclopentadienyl manganese tricarbonyls which, as aforediscussed, are known antiknocks. Their preparation and use are described in U.S. Pat. Nos. 2,818,417; 2,839,552; and 3,127,351. An especially effective compound of this type is methylcyclopentadienyl manganese tricarbonyl. The amount of cyclopentadienyl manganese tricarbonyl added to the fuel composition should be in the range of from about 0.01 to about 1.0 grams per gallon of manganese as a cyclopentadienyl manganese tricarbonyl. A more preferred range is from about 0.03 to about 0.50 grams of manganese per gallon as a cyclopentadienyl manganese tricarbonyl. A most preferred range is from about 0.06 to about 0.25 grams of manganese per gallon as methylcyclopentadienyl manganese tricarbonyl.

Preferred organic nitrates are substituted or unsubstituted alkyl or cycloalkyl nitrates having up to 10 carbon atoms, preferably from 3–10 carbon atoms. The alkyl group may be either linear or branched. Specific examples of nitrate compounds suitable for use in the present invention include, but are not limited to the following:

n-Propyl nitrate
Isopropyl nitrate
Allyl nitrate
n-Butyl nitrate
Isobutyl nitrate
sec-Butyl nitrate
tert-Butyl nitrate
n-Amyl nitrate
Isoamyl nitrate
2-Amyl nitrate
3-Amyl nitrate
tert-Amyl nitrate
n-Hexyl nitrate
2-Ethylhexyl nitrate
n-Heptyl nitrate
sec-Heptyl nitrate
n-Octyl nitrate
sec-Octyl nitrate
n-Nonyl nitrate
n-Decyl nitrate
n-Dodecyl nitrate
Cyclopentylnitrate
Cyclohexylnitrate
Methylcyclohexyl nitrate
Isopropylcyclohexyl nitrate and the esters of alkoxy substituted aliphatic alcohols, such as 1-methoxypropyl-2-nitrate, 1-ethoxypropyl-2-nitrate, 1-isopropoxybutyl nitrate, 1-ethoxybutyl nitrate and the like. Preferred alkyl nitrates are amyl nitrates and hexyl nitrates. A more preferred alkyl nitrate is a mixture of primary amyl nitrates or primary hexyl nitrates. By primary is meant that the nitrate functional group is attached to a carbon atom which is attached to two hydrogen atoms. Examples of primary hexyl nitrates would be n-hexyl nitrate, 2-ethylhexyl nitrate, 4-methyl-n-pentyl nitrate and the like. An especially preferred alkyl nitrate is a mixture of primary hexyl nitrates. Preparation of the nitrate esters may be accomplished by any of the commonly used methods; such as, for example, esterification of the appropriate alcohol, or reaction of a suitable alkyl halide with silver nitrate.

In a dynamometer test in which a conventional diesel engine was operated at steady-state conditions on No. 2 diesel fuel containing 0.3 volume percent of a mixture of primary hexyl nitrates and 0.25 grams of manganese as methylcyclopentadienyl manganese tricarbonyl, it was demonstrated that particulate emissions were reduced 25 percent to 50 percent compared to a similar test using No. 2 diesel fuel containing neither organic nitrate or cyclopentadienyl manganese compound. This suggests that similar combinations of other cyclopentadienyl manganese compounds and organic nitrates such as those aforediscussed, can be added to diesel fuel to reduce particulate emissions.

Additional chassis dynamometer tests in which a conventional diesel engine was operated at steady-state conditions on No. 2 diesel fuel containing 0.6 grams of manganese as methylcyclopentadienyl manganese tricarbonyl and 0.6 volume percent of a mixture of primary hexyl nitrates, it was demonstrated that particulate emissions were reduced approximately 25% compared to similar tests using No. 2 diesel fuel which did not contain manganese together with a mixture of primary hexyl nitrates. Particulate measurements were made on the chassis dynamometer at 25 mph road load using samples taken from an EPA-type dynamic dilution tunnel. In this system, the total engine exhaust stream is constantly fed into a tunnel or duct that also has a continuous supply of fresh, treated air. Flow is maintained by a constant-volume blower at one end of the duct. Exhaust and fresh air are mixed near the upstream end of the duct and the mixture sampled downstream. Air dilution is required to prevent condensation of the fuel on the inside walls of the tunnel. In operation, the dilution tube provides a mixture which when sampled at a uniform rate will yield a sample proportional to tailpipe output. In the present system, dilution air is mixed with engine exhaust gas in an orifice-jet 20 feet downstream from the sampling point. An isokinetic sampling probe draws 6.9 cfm of the mixture through a glass-paper filter which is weighed and analyzed for particulate emissions. The filter is positioned external to the tunnel. A 600 cfm positive displacement blower draws the mixed gases through the system and vents the gases outside. The tunnel consists of two 1.5 ft×10 ft. flanged stainless steel pipe sections coupled to a 5 ft. transition section where the sample is withdrawn. A 90 mm glass fiber filter was used. Sample time was one minute. Longer sample times are not feasible because of rapid filter clogging. Isokinetic sampling is desirable to insure that the particulate sampled is representative of the particulate in the mainstream; that is, the particulate concentration of such distribution in the probe sampled should correspond to that of the mainstream. Probes for isokinetic sampling are designed so that the sample stream is divided into two parts with a volume ratio equal to the ratio of the cross-sectional areas of the openings of the sample probes and the dilution cross-sectional area.

Five separate tunnel runs were made using No. 2 diesel fuel oil. In each run, the filter was withdrawn after one minute and weighed. The individual weights of the 5 filters were added together and averaged in order to establish an average baseline. This was followed by 5 separate tunnel runs using No. 2 diesel fuel containing 0.6 manganese as methylcyclopentadienyl manganese tricarbonyl and 0.6 percent by volume of a mixture of primary hexyl nitrates. As before, the filters from each run were removed after one minute and weighed. The individual weights of the filters were then added together and averaged and compared to baseline. Finally, 5 more tunnel runs were made using No. 2 diesel fuel only to establish an average baseline following tests with the additives. The results are recorded in the following table. As shown, there were approximately a 25% reduction in the particulate emissions with the test fuel containing the additives when compared to initial baseline and approximately a 21% reduction when compared to baseline established following testing with the fuel containing additives.

Conventional blending equipment and techniques may be used in preparing the fuel composition of the present invention. In general, the cyclopentadienyl manganese compound and the organic nitrate additives of the present invention are preformed, and subsequently added to or blended with the hydrocarbon fuel in a determined proportion sufficient to reduce the particulate emitting tendencies of the fuel. In addition to the alkyl nitrate and cyclopentadienyl manganese compound additives of the present invention, the fuel compositions may also contain other additives such as corrosion inhibitors, phenolic antioxidants, cold-flow improvers, dyes, and the like, provided they do not adversely effect the particulate emission reducing effectiveness of the alkyl nitrate and cyclopentadienyl manganese compound additives.

TABLE 1

| | Run No. | 1 minute samples, mgs. |
|---|---|---|
| Initial Baseline (No. 2 Diesel Fuel) | | |
| | 1 | 1.918 |
| | 2 | 1.869 |
| | 3 | 1.865 |
| | 4 | 1.804 |
| | 5 | 1.829 |
| Average Baseline | | 1.862 |
| Test Fuel[1] | | |
| | 1 | 1.431 |
| | 2 | 1.310 |
| | 3 | 1.521 |
| | 4 | 1.470 |
| | 5 | 1.495 |
| Average | | 1.445 |
| Final Baseline (No. 2 Diesel Fuel) | | |
| | 1 | 1.826 |
| | 2 | 1.874 |
| | 3 | 1.835 |
| | 4 | 1.771 |
| | 5 | 1.703 |
| Average Baseline | | 1.822 |

[1]1.0 gal. No. 2 diesel fuel + 0.6 gram manganese + 0.6 volume percent primary hexyl nitrates.

I claim:

1. An improved fuel composition comprising a major amount of a fuel oil and a minor amount sufficient to inhibit particulate emission, of (a) a cyclopentadienyl manganese tricarbonyl, and (b) a lower alkyl or cycloalkyl nitrate.

2. The fuel composition of claim 1 wherein said cyclopentadienyl contains from 5–7 carbon atoms.

3. The fuel composition of claim 2 wherein said cyclopentadienyl is methylcyclopentadienyl.

4. The fuel composition of claim 3 wherein said alkyl nitrate contains from 3 to 10 carbon atoms per molecule.

5. The fuel composition of claim 4 wherein said alkyl nitrate is n-hexyl nitrate.

6. The fuel composition of claim 4 wherein said alkyl nitrate is 2-ethylhexyl nitrate.

7. The fuel composition of claim 4 wherein said alkyl nitrate is n-amyl nitrate.

8. The fuel composition of claim 4 wherein said alkyl nitrate is iso-amyl nitrate.

9. The fuel composition of claim 4 wherein said alkyl nitrate is selected from (i) mixtures of amyl and hexyl nitrates, (ii) mixtures of primary amyl nitrates, and (iii) mixtures of primary hexyl nitrates.

10. The fuel composition of claim 9 wherein said alkyl nitrate is a mixture of primary hexyl nitrates.

11. The fuel composition of claim 9 wherein said alkyl nitrate is a mixture of primary amyl nitrates.

12. The fuel composition of claim 3 containing from about 0.01 to about 1.0 grams of manganese per gallon as methylcyclopentadienyl manganese tricarbonyl.

13. The fuel composition of claim 12 containing from about 0.06 to about 0.25 grams of manganese per gallon as methylcyclopentadienyl manganese tricarbonyl.

14. The fuel composition of claim 12 wherein said alkyl nitrate is present in said fuel oil in an amount of from about 0.05 percent by volume to about 1.0 percent by volume.

15. The fuel composition of claim 14 wherein said alkyl nitrate is present in said fuel oil in an amount of from about 0.05 percent by volume to about 0.5 percent by volume.

16. An improved fuel composition comprising a major amount of a fuel oil containing from about 0.01 to about 1.0 grams of manganese per gallon as methylcyclopentadienyl manganese tricarbonyl and from about 0.05 percent by volume to about 1.0 percent by volume of a mixture of primary amyl nitrates.

17. The fuel composition of claim 16 containing from about 0.06 to about 0.25 grams of manganese per gallon as methylcyclopentadienyl manganese tricarbonyl and from about 0.05 percent by volume to about 0.5 percent by volume of a mixture of primary amyl nitrates.

18. An improved fuel composition comprising a major amount of a fuel oil containing from about 0.01 to about 1.0 grams of manganese per gallon as methylcyclopentadienyl manganese tricarbonyl and from about 0.05 percent by volume to about 1.0 percent by volume of a mixture of primary hexyl nitrates.

19. The fuel composition of claim 18 containing from about 0.06 to about 0.25 grams of manganese per gallon as methylcyclopentadienyl manganese tricarbonyl and from about 0.05 percent by volume to about 0.5 percent by volume.

20. An improved fuel composition comprising a major amount of a fuel oil and from about 0.01 to about 1.0 grams of manganese per gallon as methylcyclopentadienyl manganese tricarbonyl and from about 0.5 percent by volume to about 1.0 percent by volume of n-hexyl nitrate.

21. The fuel composition of claim 20 containing from about 0.06 to about 0.25 grams of manganese per gallon as methylcyclopentadienyl manganese tricarbonyl and from about 0.05 percent by volume to about 0.5 percent by volume of n-hexyl nitrate.

22. An improved fuel composition comprising a major amount of a fuel oil containing from about 0.01 to about 1.0 grams of manganese per gallon as methylcyclopentadienyl manganese tricarbonyl and from about 0.05 percent by volume to about 1.0 percent by volume of 2-ethylhexyl nitrate.

23. The fuel composition of claim 22 containing from about 0.06 to about 0.25 grams of manganese per gallon as methyl cyclopentadienyl manganese tricarbonyl and from about 0.05 percent by volume to about 0.5 percent by volume of 2-ethylhexyl nitrate.

* * * * *